US007755496B1

(12) United States Patent
Bernstein

(10) Patent No.: US 7,755,496 B1
(45) Date of Patent: Jul. 13, 2010

(54) SYSTEM FOR DIRECTING A LOST PERSON TO A RESCUE LOCATION

(76) Inventor: Michael Bernstein, 107 Orlando Ave., Albany, NY (US) 12203

( * ) Notice: Subject to any disclaimer, the term of this patent is extended or adjusted under 35 U.S.C. 154(b) by 355 days.

(21) Appl. No.: 12/069,622

(22) Filed: Feb. 12, 2008

(51) Int. Cl.
*G08B 23/00* (2006.01)

(52) U.S. Cl. ..... 340/573.1; 340/573.3; 340/815.69

(58) Field of Classification Search ..... 340/573.1, 340/573.3, 573.4, 981, 384.4, 815.4, 815.69; 342/357.09, 357.1; 116/209, 210, 211; 244/33
See application file for complete search history.

(56) References Cited

U.S. PATENT DOCUMENTS

| | | | | |
|---|---|---|---|---|
| 2,477,857 | A | 8/1949 | Boeve et al. | |
| 3,115,635 | A | 12/1963 | Leeming, Jr. et al. | |
| 3,696,381 | A | 10/1972 | Wallace | |
| 3,806,936 | A | 4/1974 | Koster | |
| 3,941,079 | A | 3/1976 | McNeill | |
| 4,416,433 | A * | 11/1983 | Bellina | 244/33 |
| 5,095,845 | A | 3/1992 | Murphy | |
| 5,429,244 | A | 7/1995 | McCreary | |
| 6,195,039 | B1 * | 2/2001 | Glass, Jr. | 342/357.09 |
| 6,222,484 | B1 | 4/2001 | Seiple et al. | |
| 6,254,159 | B1 | 7/2001 | Wieczoreck et al. | |
| 6,260,508 | B1 * | 7/2001 | Morse | 116/211 |
| 6,523,778 | B2 * | 2/2003 | Key et al. | 244/31 |
| 2005/0193941 | A1 * | 9/2005 | Schlasinger | 116/209 |
| 2006/0154219 | A1 * | 7/2006 | Singer | 434/219 |
| 2008/0024365 | A1 * | 1/2008 | Holmes et al. | 342/418 |

* cited by examiner

*Primary Examiner*—Van T. Trieu
(74) *Attorney, Agent, or Firm*—Maxine Barasch & Associates, PLLC

(57) ABSTRACT

A system for directing a lost person to a predetermined location for pickup including a tethered balloon or other highly visible signal deployed at the pickup location. A manned or remotely controlled aircraft is provided for flying over the area in which the lost person is presumed to be located. The aircraft is equipped with a downward directed loudspeaker broadcasting an audible message instructing the lost person to walk towards the balloon or other signal at the rescue location. The aircraft may be a fixed-wing or rotary-wing aircraft, and airship such as a dirigible or blimp, an ultralight, or a hybrid aircraft.

16 Claims, 5 Drawing Sheets

SYSTEM FOR DIRECTING A LOST PERSON TO A RESCUE LOCATION

FIELD OF THE INVENTION

The invention pertains to personal locating and rescue systems and, more particularly, to a system for guiding a lost person to a predetermined rescue or pickup location.

BACKGROUND OF THE INVENTION

Each year, numerous people become lost, typically in areas such as unfamiliar wooded terrain, the desert, or at sea. Such people include hunters and fishermen, campers, hikers, and other outdoor adventurers. Some experienced outdoorsmen are prepared for the eventuality of becoming disoriented or lost and carry maps, GPS equipment, direction finders, locator beacons, or other aids to guide themselves back to a known point. Many less experienced people, however, are completely unprepared and have no locator aids or devices with them.

Of particular concern are people without outdoor experience and who find themselves lost in a "wilderness" due to unforeseen circumstances. For example, a family is driving in a remote area and runs out of gas. One family member may go for help and become lost. In a recent case, rescue workers found the remaining family members at their car but could not locate the family member who had gone for help and who eventually died.

It is both time consuming and expensive to try to find lost or stranded people, even when someone is aware that they are missing. Often a considerable period of time may elapse before anyone realizes that these people are lost or missing. In some circumstances, lost or stranded people may die before they can be reached.

Personal location systems are well known in the prior art. Devices that transmit an emergency radio signal, flare guns, tethered balloons, and other such devices may be used to guide searchers to the location of the lost person.

DISCUSSION OF THE RELATED ART

U.S. Pat. No. 2,477,857 for ANNUNCIATOR, issued Aug. 2, 1949 to John Boeve, et al., discloses a time arrangement useful for periodically activating a sound-producing device such as a horn. The horn is used to help guide a distant person towards the horn's location.

U.S. Pat. No. 3,115,635 for PORTABLE DIRECTION FINDER, issued Dec. 24, 1963 to John H. Leeming, Jr., et al., provides a small radio direction finder useful for determining the direction to a broadcast transmitter.

U.S. Pat. No. 3,696,381 for TIME CONTROLLED ALARM SYSTEM HAVING ACTUATOR MOVING ALONG ROTATING SHAFT, issued Oct. 3, 1972 to Archie C. Wallace, discloses another apparatus for periodically actuating a sound-producing device for guiding a person thereto-wards.

U.S. Pat. No. 3,806,936 for PERSONAL LOCATOR, issued Apr. 23, 1974 to Chester A Koster, teaches a self-contained radio receiver and transmitter capable for transmitting an emergency distress signal. The radio receiver may act as a direction finder.

U.S. Pat. No. 3,941,079 for EMERGENCY LOCATING DEVICE, issued Mar. 2, 1976 to John McNeill, discloses an inflatable balloon for signaling the location of a lost or injured person.

U.S. Pat. No. 5,095,845 for EMERGENCY SIGNALING SYSTEM, issued Mar. 17, 1992 to Betty J. Murphy, discloses another inflatable, tethered balloon. The MURPHY balloon, however, reflects electromagnetic energy in at least two distinct bandwidths to facilitate both visual and electronic detection of the balloon.

U.S. Pat. No. 5,429,244 for RESCUE KIT, issued Jul. 4, 1995 to James L. McCreary, discloses another inflatable, tethered balloon designed to be carried by a person having the potential for becoming lost.

U.S. Pat. No. 6,222,484 for PERSONAL EMERGENCY LOCATION SYSTEM, issued Apr. 24, 2001 to Ronald Seiple, et al., teaches a kit having both an inflatable balloon and a radio frequency transmitter for guiding a searcher to the wearer thereof.

U.S. Pat. No. 6,254,159 for OFFROAD SEARCH AND RESCUE VEHICLE, issued Jul. 3, 2001 to Ardell G. Wieczoreck, et al., provides a vehicle-drawn apparatus emanating both audio and video signals to attract a lost person. The apparatus also carries rescue and medical equipment. A recorded message may be played through a speaker mounted on the vehicle. In addition, a microphone and signal processing equipment may be provided to detect a sound generated by the missing person.

None of the patents, taken singly, or in any combination are seen to teach or suggest the novel system for directing a lost person to a rescue location as provided by the present invention.

SUMMARY OF THE INVENTION

In accordance with the present invention, there is provided a system for directing a lost person to a predetermined location for pickup. A tethered balloon or other highly visible signal, having a light-generating mechanism such as a rotary beacon or strobe, is deployed at the pickup location. A manned or remotely controlled aircraft is provided for flying over the area in which the lost person is presumed to be located. The aircraft is equipped with a downward-directed loudspeaker broadcasting an audible message instructing the lost person to walk towards the balloon or other signal at the rescue location. The aircraft may be a fixed-wing or rotary-wing aircraft, and airship such as a dirigible or blimp, or a hybrid aircraft.

It is, therefore, an object of the invention to provide a system for directing a lost person to a rescue location wherein a balloon or other highly visible signal is placed at the rescue location.

It is another object of the invention to provide a system for directing a lost person to a rescue location wherein the visible signal may be illuminated.

It is an additional object of the invention to provide a system for directing a lost person to a rescue location by providing an aircraft to over fly an area presumed to contain a lost person.

It is a further object of the invention to provide a system for directing a lost person to a rescue location wherein an aircraft is equipped to broadcast a downwardly-directed audible message.

It is a still further object of the invention to provide a system for directing a lost person to a rescue location wherein an aircraft is a fixed-wing aircraft, a rotary-wing aircraft, or a lighter-than-air aircraft.

It is yet another object of the invention to provide a system for directing a lost person to a rescue location wherein an aircraft is either a manned aircraft or an unmanned remotely guided aircraft.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENT

The present invention provides a search and rescue system designed to guide a lost person to a fixed location. The term, "search and rescue station" is used herein to designate a fixed location towards which a lost person is directed using the apparatus and method of the invention. The search and rescue station may consist of an existing facility and have a permanent structure. At other times, a search and rescue station may be designated at a geographic location with no permanent or temporary structure(s). A fixed, elevated beacon is disposed at the search and rescue station.

An aircraft is dispatched to overfly the area where the lost person is assumed to be located. The term, "aircraft," is used herein to designate any fixed-wing or rotary-wing aircraft, an airship such as a dirigible or blimp, an ultralight, or a hybrid aircraft. Preferably, a lighter-than-air aircraft (i.e., airship, dirigible, or blimp, etc.) is utilized. The aircraft is equipped with a downwardly directed audio system (i.e. public address or PA system), designed to deliver an audible message to the lost person. The message typically advises the lost person to locate the light and walk towards the source of the light. In an alternate embodiment of the invention, a banner or other similar visible device, visually displaying the message may be attached to or trailed by the aircraft. The banner may be used either in conjunction with, or instead of, an audio message.

Figure 1:
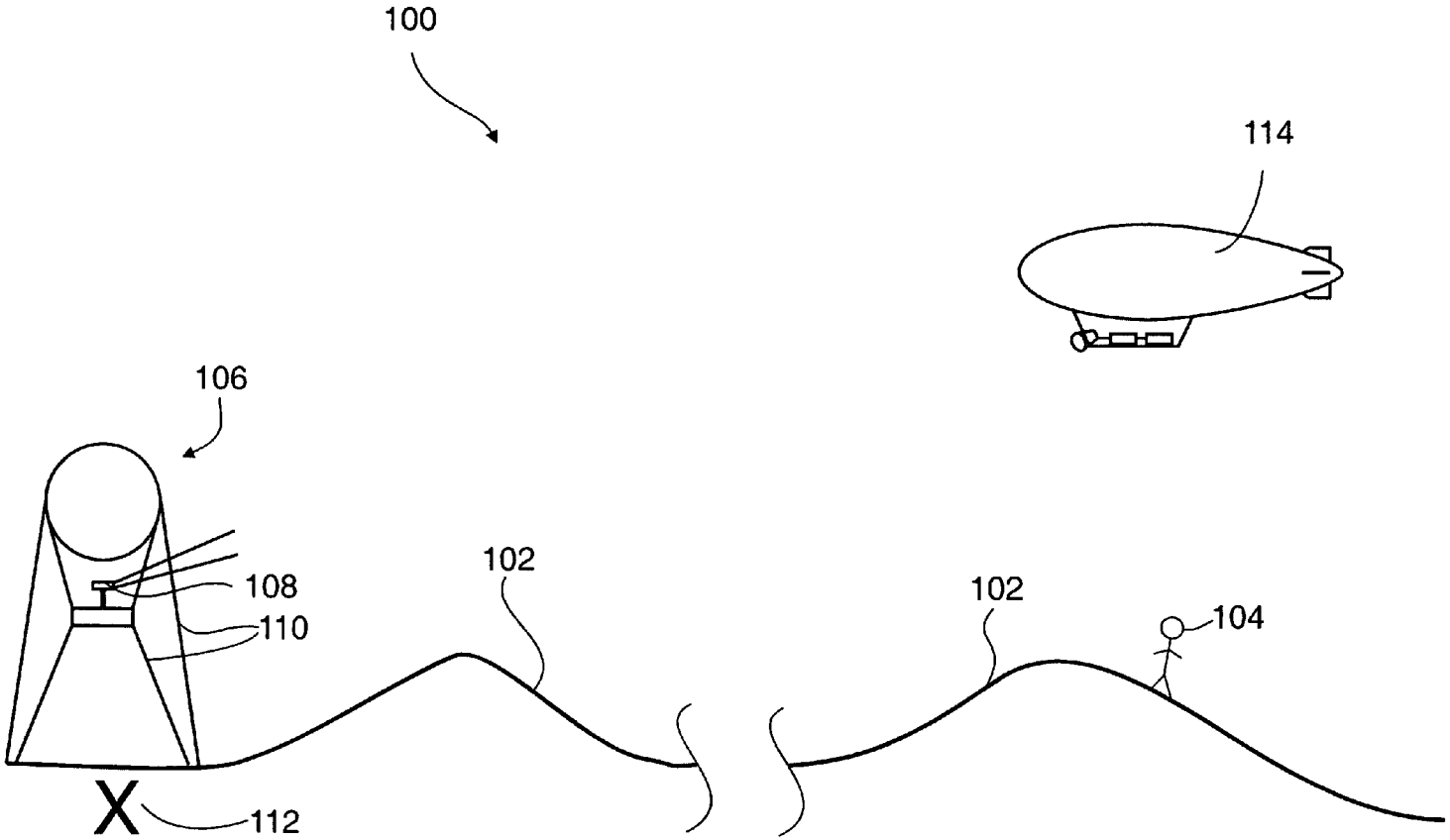
FIG. 1 is a simplified schematic diagram of the system of the present invention.

Referring first to FIG. 1, there is shown a simplified schematic diagram of the system of the present invention, generally at reference number 100. Terrain 102 schematically represents a region in which a person 104 is lost or disoriented.

A balloon 106 carrying a beacon 108 is tethered at a search and rescue station 112 by one or more tether cables 110.

An aircraft 114, represented schematically as an airship, is provided to overfly terrain 102 and broadcast an audio message.

Figure 2:
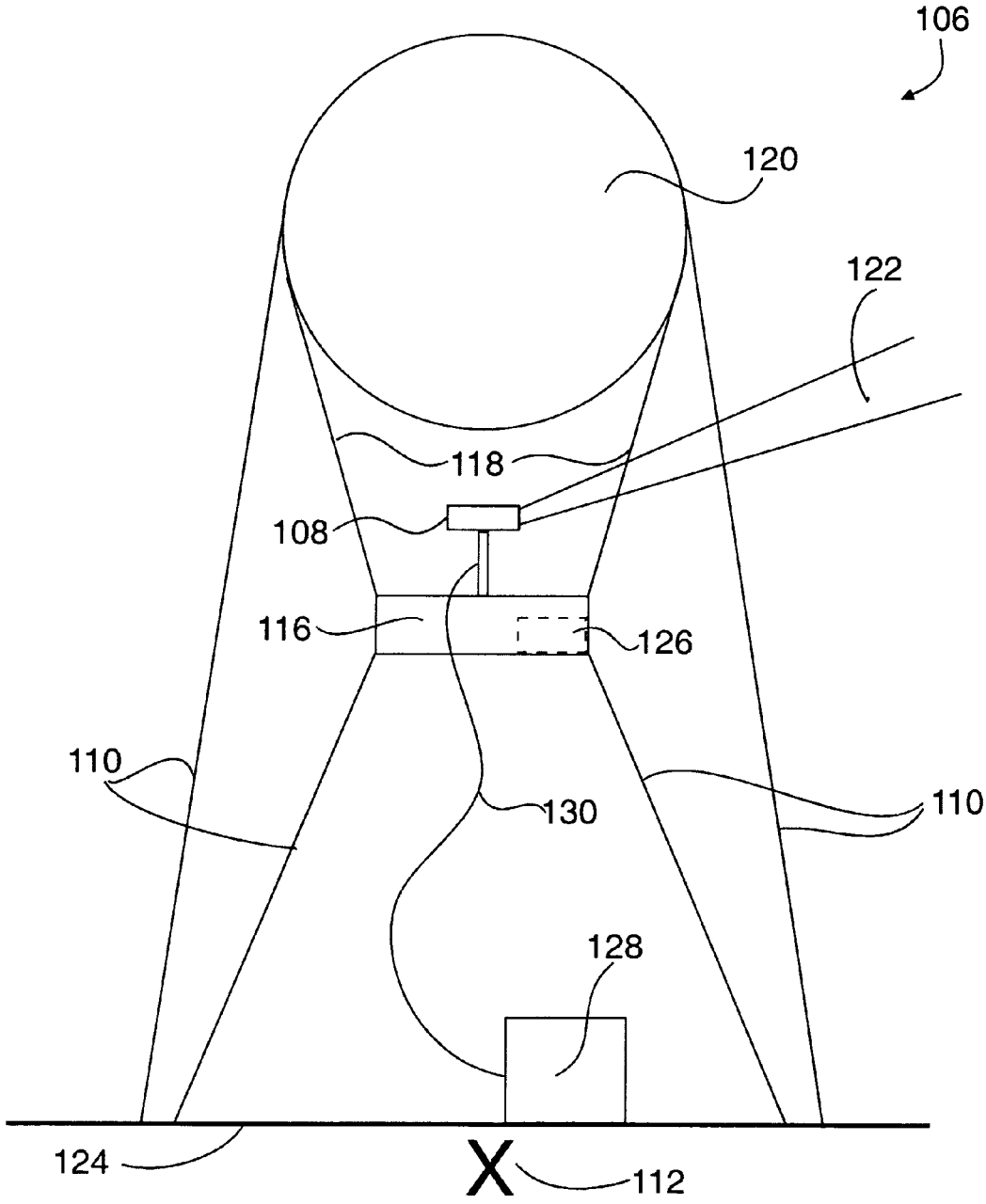
FIG. 2 is a detailed schematic view of the tethered balloon of FIG. 1.

Referring now to FIG. 2, there is shown a schematic representation of balloon 106. A balloon 106 has an envelope or body 120 filled with a lighter-than-air (LTA) gas, not shown. Such balloon envelopes 120 and suitable LTA gases are believed to be known to those of skill in the art and are not discussed in detail herein. Typically, Helium is selected for both its buoyancy and inert properties. Other LTA gases may, of course, be substituted for Helium.

A basket or car 116 is suspended below balloon envelope 120 by supporting strands 118. A beacon 108, typically a rotating apparatus for projecting a focused light beam 122 is supported by car 116. The light beam is preferably angled between approximately 5 and 10 degrees from the ground 124 above which balloon 106 is moored and tethered. It will be recognized that other beam angles may be selected to meet a particular operating circumstance or environment. Consequently, the invention is not limited to the beam angle range chosen for purposes of disclosure. Rather, the invention includes any suitable beam angle. In alternate embodiments, a strobe light, not shown, or other such light generator may be substituted for beacon 108.

Beacon 108 is powered by either a battery 126, preferably a rechargeable battery, or via an electrical connection 130 to a power source 128 on the ground 124. Power source 128 may be a stand-alone generator, a vehicle electrical system, a rechargeable battery, or any other type of power source capable of powering beacon 108. Electrical connection 130 is sized to carry the required electrical current from power source 128 to beacon 108 without excessive voltage drop. Electrical connection 130 may be an independent cable from balloon 108 to ground 124 or, in alternate embodiments, tether cables 110 may provide conductive paths between ground power source 128 and beacon 108.

Balloon 106 is moored using one or more tethers 110. A proximal end of tethers 110 is anchored to ground 124 using any suitable apparatus, not shown, by a method believed to be well known to those of skill in the art. A distal end of tethers 110 is attached to balloon envelope 120 and/or balloon car 116. Tethers 110 attached to both balloon envelope 120 and balloon car 116 may be required to provide necessary stability to balloon 106 to provide a functional platform for beacon 108.

Figure 3:
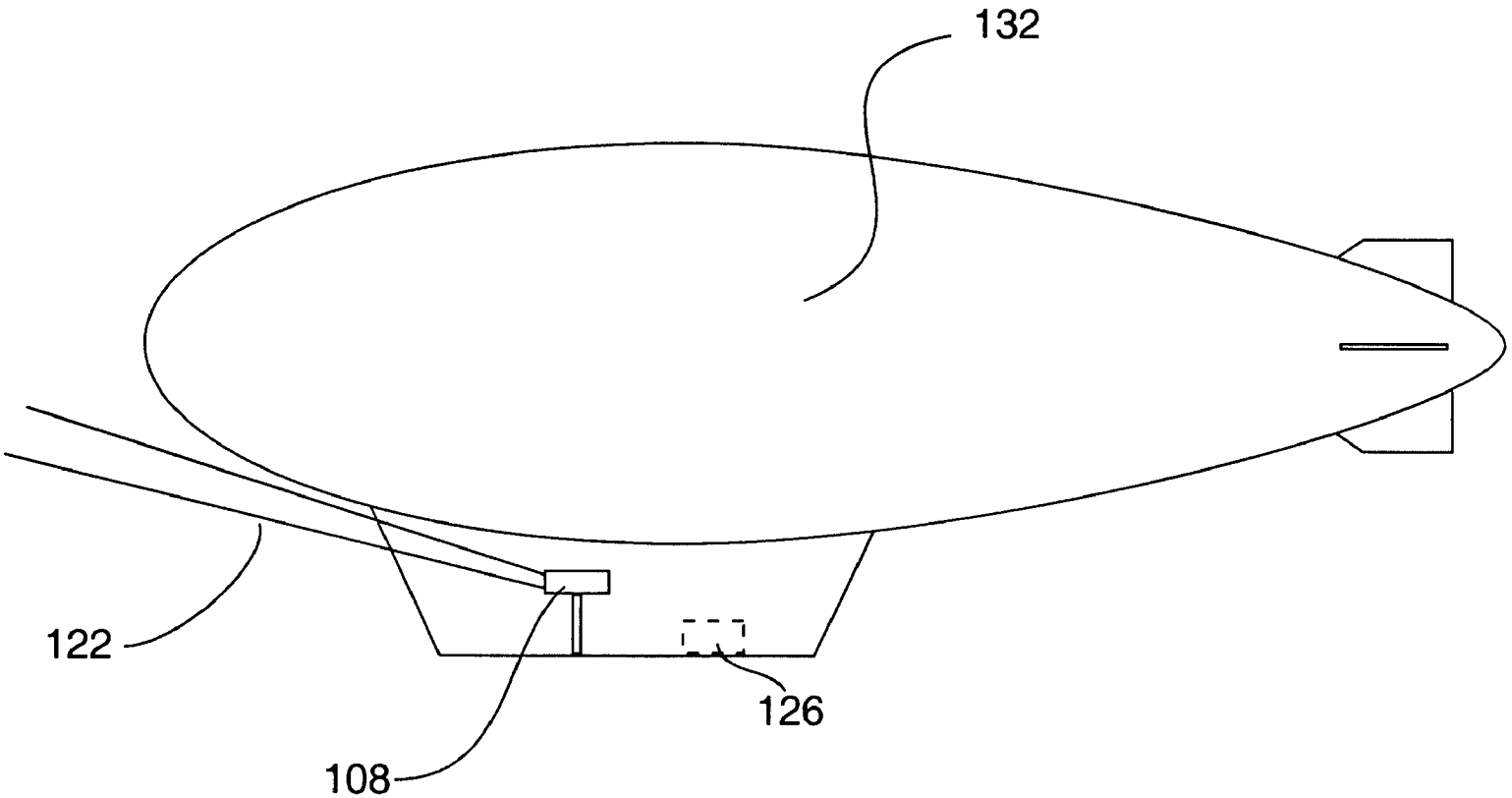
FIG. 3 is a detailed schematic view of a lighter-than-air aircraft, which may be substituted for the balloon of FIG. 1.

Referring now to FIG. 3, there is shown a detailed schematic view of a lighter-than-air aircraft 132, which may be substituted for balloon 106 (FIGS. 1 and 2) to support a beacon 108 in an alternate embodiment of the inventive system. A battery 126 is provided and operatively connected to beacon 108. Preferably, battery 126 is a rechargeable battery charged from the electrical system, not shown, of aircraft 132, if a suitable electrical system is present. In alternate embodiments, battery 126 may be charged or replaced on the ground, not shown, by first landing aircraft 132.

Figure 4:
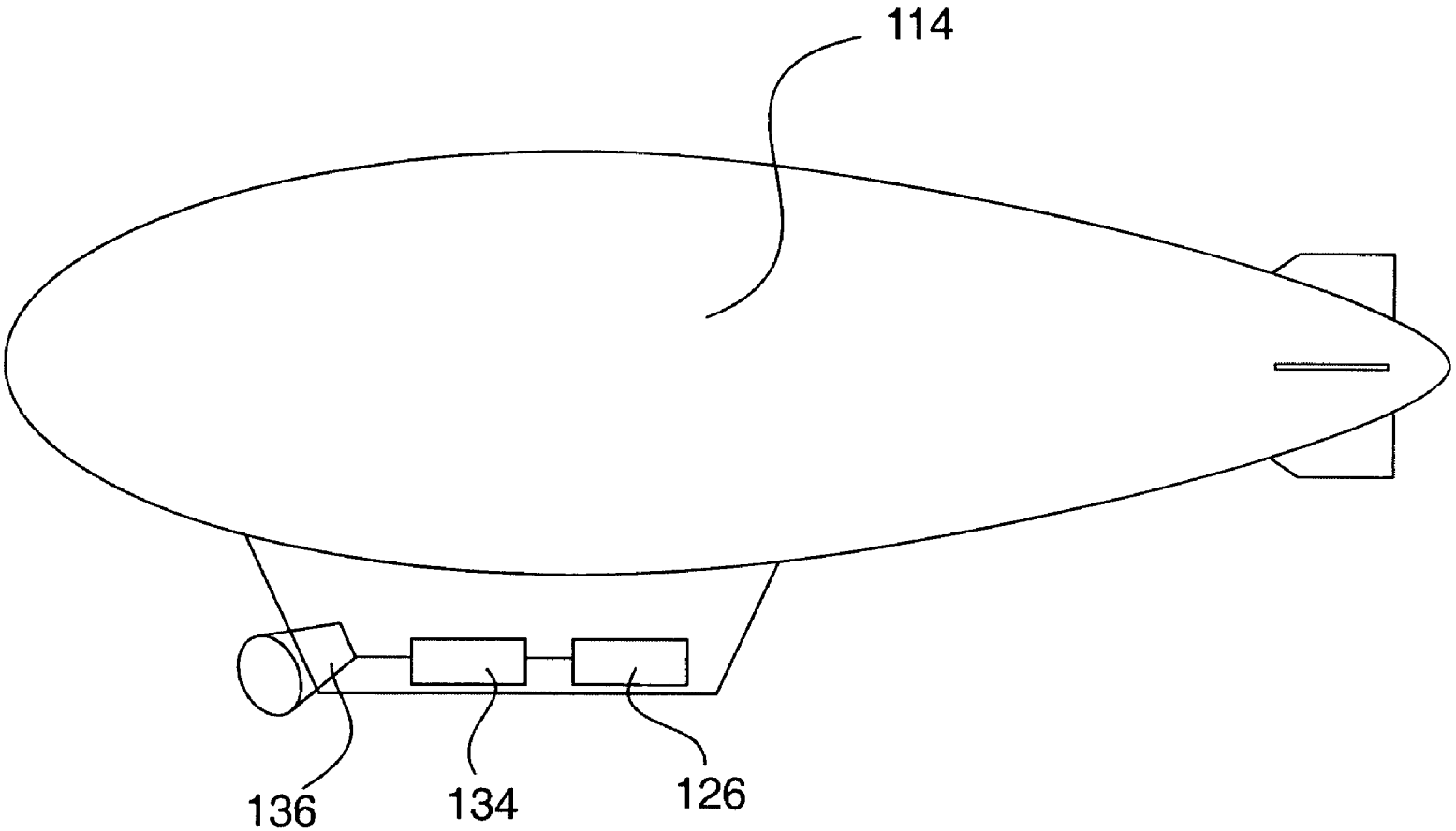
FIG. 4 is a detailed schematic view of a first embodiment of the aircraft of FIG. 1.

Referring now to FIG. 4, there is shown a detailed schematic view of a first embodiment of an aircraft 114. Aircraft 114 may be of any type, including but not limited to fixed-wing or rotary-wing aircraft, an airship such as a dirigible or blimp, an ultralight, or a hybrid aircraft. Aircraft 114 may be manned or unmanned (i.e., remotely or automatically guided). If a manned aircraft is used, a person aboard the aircraft can spot a person on the ground who may be too badly injured or otherwise incapacitated to move toward the visual signal, or light. Although an airship is illustrated for purposes of disclosure, the airship is meant to represent any type of aircraft capable of performing as described in detail hereinbelow.

Aircraft 114 is equipped with a sound system consisting of a loudspeaker 136, and an amplifier and associated electronic components 134 capable of directing an audible message to lost person 104 (FIG. 1). Note that the loudspeaker 136 and amplifier 134 may be combined into a single device. The message may be a recorded message or a message transmitted to and received by aircraft 114. Apparatus for implementing an audio system (e.g., speakers, amplifiers, sound recorders, etc.) is believed to be well known and are not further described herein. Power for electronic components 134 is provided by a battery 126 or another electrical power source, not shown, associated with aircraft 114.

An airship is preferred because typically the noise produced by the airship engine(s), not shown, is lower than the noise produced by the engines, not shown, of other types of aircraft, not shown. This allows the audible message being originated at aircraft 114 by sound system 136 to be more readily heard and understood by lost person 104 (FIG. 1).

Referring again to FIG. 1, in operation, the system 100 is deployed upon report of a lost person in a specific area. A search and rescue site is preferably situated in the center of the area to be searched, however, it may be located elsewhere due to many factors including ease of access by a person or persons deploying balloon 106.

Balloon 106 is deployed and beacon 108 started. For most effective viewing, beacon 108 may be illuminated only after dark.

Aircraft 114 is flown over the area where lost person 104 is presumed to be located. While traversing the area, speaker system 136 of aircraft 114 originates a downward directed, audible message instructing lost person 104 to walk towards the source of the light beam 122 from beacon 108. Aircraft 114 may be a manned aircraft or a remotely controlled drone.

Figure 5:
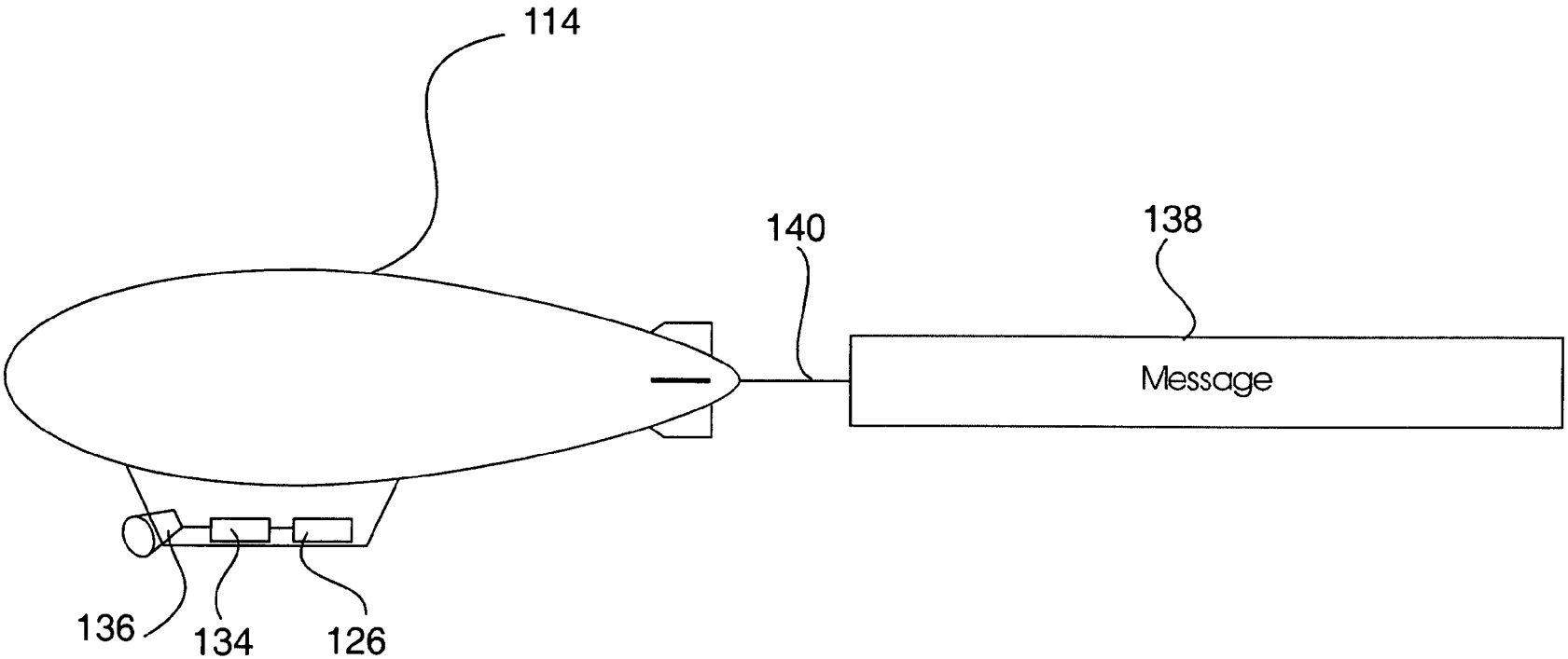
FIG. 5 is a detailed schematic view of the aircraft of FIG. 4 trailing a message-bearing banner.

FIG. 5 shows a schematic view of aircraft 114 with a message-bearing banner 138 attached to aircraft 114 via a tether cable 140. The use of aircraft to trail banners and the like is believed to be well known to those of skill in the art and is not further described herein.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A system for helping a lost person locate a predetermined location, comprising:

a) a visible signal displayed at a rescue location; and b) an aircraft for traversing an area and having means for broadcasting an audible message.

2. The system for helping a lost person locate a predetermined location as recited in claim 1, wherein said visible signal comprises a balloon and a light source.

3. The system for helping a lost person locate a predetermined location as recited in claim 2, wherein said light source comprises at least one light source selected from the group: a rotating beacon, and a strobe light.

4. The system for helping a lost person locate a predetermined location as recited in claim 1, wherein said means for broadcasting comprises at least one device selected from the group: a loudspeaker, an amplifier, and means for reproducing a recorded message.

5. The system for helping a lost person locate a predetermined location as recited in claim 1, wherein said aircraft comprises at least one of the types selected from the group: fixed-wing, rotary-wing, lighter-than-air, and hybrid.

6. The system for helping a lost person locate a predetermined location as recited in claim 5, wherein said aircraft comprises a manned aircraft.

7. The system for helping a lost person locate a predetermined location as recited in claim 5, wherein said aircraft comprises an unmanned, remotely controlled aircraft.

8. The system for helping a lost person locate a predetermined location as recited in claim 5, further comprising:

c) a message-bearing banner flexibly attached to said aircraft such that said message-bearing banner trails behind said aircraft when said aircraft is flown.

9. A method of assisting a lost person in locating a predetermined rescue location, the steps comprising:

a) providing a first lighter-than-air aircraft having a light source attached thereto;

b) elevating and tethering said first lighter-than-air aircraft at said search and rescue site;

c) providing a second aircraft having a sound system enabled to broadcast an audible message therefrom;

d) flying said second aircraft over an area presumed to contain a lost person; and e) broadcasting from said sound system an audible message directing said lost person to move towards a light beam projected from said light source.

10. The method of assisting a lost person to locate a predetermined rescue location as recited in claim 9, wherein said providing step (a) comprises providing a first lighter-than-air aircraft having a rotary beacon attached thereto.

11. The method of assisting a lost person to locate a predetermined rescue location as recited in claim 10, the steps further comprising:

f) illuminating said rotary beacon.

12. The method of assisting a lost person to locate a predetermined rescue location as recited in claim 11, wherein said providing step (c) comprises supplying a second aircraft selected from the group: fixed-wing, rotary-wing, airship, dirigible, blimp, ultralight, and hybrid.

13. The method of assisting a lost person to locate a predetermined rescue location as recited in claim 9, wherein said first lighter-than-air aircraft comprises a balloon.

14. The method of assisting a lost person to locate a predetermined rescue location as recited in claim 13, wherein said providing step (a) comprises providing a balloon having a rotary beacon attached thereto.

15. The method of assisting a lost person to locate a predetermined rescue location as recited in claim 14, the steps further comprising:

f) illuminating said rotary beacon.

16. The method of assisting a lost person to locate a predetermined rescue location as recited in claim 13, wherein said providing step (c) comprises supplying a second aircraft selected from the group: fixed-wing, rotary-wing, airship, dirigible, blimp, ultralight, and hybrid.

* * * * *